US010321772B2

(12) United States Patent
Demircift et al.

(10) Patent No.: US 10,321,772 B2
(45) Date of Patent: Jun. 18, 2019

(54) DISPLAY DEVICE AND METHODS OF USE

(71) Applicant: Tynies, Inc., Glendora, CA (US)

(72) Inventors: Jay Cecil Demircift, La Verne, CA (US); Sean Serkan Demircift, La Verne, CA (US); Christopher A R Power, Davao (PH)

(73) Assignee: Tynies, Inc., Glendora, CA (US)

( * ) Notice: Subject to any disclaimer, the term of this patent is extended or adjusted under 35 U.S.C. 154(b) by 0 days.

(21) Appl. No.: 15/770,166

(22) PCT Filed: Dec. 23, 2016

(86) PCT No.: PCT/US2016/068534

§ 371 (c)(1),
(2) Date: Apr. 20, 2018

(87) PCT Pub. No.: WO2017/070716

PCT Pub. Date: Apr. 27, 2017

(65) Prior Publication Data

US 2018/0303252 A1 Oct. 25, 2018

(30) Foreign Application Priority Data

Oct. 23, 2015 (PH) ..... 1-2015-000370

(51) Int. Cl.
*A47G 1/06* (2006.01)
*A47F 3/14* (2006.01)
(Continued)

(52) U.S. Cl.
CPC ..... *A47F 3/145* (2013.01); *A47F 3/005* (2013.01); *A47G 1/12* (2013.01); *A47B 87/02* (2013.01);
(Continued)

(58) Field of Classification Search
CPC ..... A47G 1/12; A47F 3/145
(Continued)

(56) References Cited

U.S. PATENT DOCUMENTS

D76,747 S 7/1928 Haills-Karlebach
D110,305 S 2/1938 Schein
(Continued)

FOREIGN PATENT DOCUMENTS

CA 2105504 A1 3/1995
WO 2008067835 A1 6/2008

OTHER PUBLICATIONS

International Search Report and Written Opinion PCT/US16/68534 dated Mar. 31, 2017.
(Continued)

*Primary Examiner* — Joanne Silbermann
(74) *Attorney, Agent, or Firm* — ENTRALTA P.C.; Justin G. Sanders; Peter D. Weinstein

(57) ABSTRACT

A display device for selectively displaying an at least one multi-dimensional object is disclosed. In at least one embodiment, the display device provides an upper portion and a corresponding lower portion configured for selective engagement with the upper portion, thereby allowing the upper portion to remain in a substantially vertical orientation. The upper portion provides a first frame and an opposing second frame selectively engageable with the first frame. The first frame provides a first aperture, the first aperture having a first window panel spanning the first aperture. The second frame provides a corresponding second aperture sized for approximating the dimensions of the first aperture, the second aperture having a second window panel spanning the second aperture. The first and second apertures cooperate to define an enclosure therebetween for selectively receiving the at least one object therewithin.

15 Claims, 4 Drawing Sheets

(51) Int. Cl.

| | |
|---|---|
| ***A47F 3/00*** | (2006.01) |
| ***A47G 1/12*** | (2006.01) |
| *A47G 1/00* | (2006.01) |
| *A47F 5/10* | (2006.01) |
| *A47B 87/02* | (2006.01) |

(52) U.S. Cl.
CPC ..... *A47F 3/004* (2013.01); *A47F 5/10* (2013.01); *A47G 2001/005* (2013.01)

(58) Field of Classification Search
USPC ..... 40/800, 734; 312/114
See application file for complete search history.

(56) References Cited

U.S. PATENT DOCUMENTS

| | | | | |
|---|---|---|---|---|
| D174,407 | S | | 4/1955 | Anderle |
| 2,774,159 | A | | 12/1956 | Wright |
| 3,270,878 | A | | 9/1966 | Giesler |
| 3,335,848 | A | | 8/1967 | Frankenberg et al. |
| D212,266 | S | | 9/1968 | Robinson et al. |
| D245,301 | S | | 8/1977 | Brandenfels |
| D259,681 | S | | 6/1981 | Bouwman |
| D267,992 | S | | 2/1983 | Shelton |
| D272,782 | S | | 2/1984 | Shelton |
| D295,806 | S | | 5/1988 | Wilson |
| D296,503 | S | | 7/1988 | Bell et al. |
| 4,852,743 | A | | 8/1989 | Ridgeway |
| D305,839 | S | | 2/1990 | Howard et al. |
| D353,092 | S | * | 12/1994 | Green ..... D9/732 |
| 5,386,911 | A | | 2/1995 | Payne |
| D357,826 | S | | 5/1995 | Fiddament |
| D359,636 | S | | 6/1995 | Rosenberg |
| 5,769,235 | A | | 6/1998 | Keach et al. |
| 5,836,450 | A | | 11/1998 | Gonzales |
| 5,871,101 | A | | 2/1999 | Alden |
| 5,979,662 | A | | 11/1999 | Green |
| D419,335 | S | | 1/2000 | Kopala, Jr. |
| D420,836 | S | | 2/2000 | Bustos et al. |
| 6,237,772 | B1 | | 5/2001 | LaMarche et al. |
| 6,367,632 | B1 | | 4/2002 | Green |
| 6,581,777 | B2 | | 6/2003 | Thibault |
| 6,889,856 | B2 | | 5/2005 | Clark et al. |
| 7,097,035 | B2 | | 8/2006 | Agakanian |
| D572,043 | S | | 7/2008 | Suzuki |
| D642,824 | S | | 8/2011 | Theisen et al. |
| 8,056,721 | B2 | | 11/2011 | Hession |
| 8,096,420 | B2 | | 1/2012 | Marhsall et al. |
| D660,051 | S | | 5/2012 | Lin |
| 8,181,377 | B2 | | 5/2012 | Lofgren et al. |
| 8,186,133 | B2 | | 5/2012 | Bacon |
| 8,191,295 | B2 | | 6/2012 | Junkins et al. |
| D687,243 | S | | 8/2013 | Kikkert et al. |
| 8,561,797 | B2 | | 10/2013 | Paschke et al. |
| 8,714,357 | B2 | | 5/2014 | Ridgeway |
| 8,727,123 | B1 | | 5/2014 | Roberts |
| 8,783,459 | B1 | | 7/2014 | Marcinkowski |
| D745,794 | S | | 12/2015 | Knoll et al. |
| D785,381 | S | | 5/2017 | Johnson |
| 9,737,808 | B2 | | 8/2017 | Andre et al. |
| 2005/0051678 | A1 | | 3/2005 | Modesto |
| 2005/0102877 | A1 | | 5/2005 | Stravitz |
| 2006/0189247 | A1 | | 8/2006 | Matheus |
| 2007/0006504 | A1 | * | 1/2007 | Kao ..... A47G 1/12 40/765 |
| 2007/0295639 | A1 | | 12/2007 | Green et al. |
| 2008/0029419 | A1 | | 2/2008 | Applebaum |
| 2009/0039742 | A1 | * | 2/2009 | Ripley, Jr. ..... A47F 3/004 312/114 |
| 2010/0326019 | A1 | | 12/2010 | Lofgren et al. |
| 2011/0315567 | A1 | | 12/2011 | Boynton et al. |
| 2015/0022066 | A1 | | 1/2015 | Dimitrakos |
| 2015/0080125 | A1 | | 3/2015 | Andre et al. |
| 2015/0294604 | A1 | | 10/2015 | Kahng |

OTHER PUBLICATIONS

Landis' Labyrinth Toy Shop A Tiny Post About Tynies! Mar. 9, 2015 http://landislabyrinth.blogspot.com/2015/03/a-tiny-post-about-tynies.html.

Toydirectory Tynies Glass Figurines Mar. 17, 2014 https://youtu.be/qCNyEaV2hEA.

* cited by examiner

DISPLAY DEVICE AND METHODS OF USE

RELATED APPLICATIONS

This application is a 35 U.S.C. 371 US national stage entry of International Application number PCT/US2016/068534, filed Dec. 23, 2016, and claims priority and is entitled to the filing date of Philippine application serial number PH 1-2015-000370, filed on Oct. 23, 2015. The contents of the aforementioned applications are incorporated herein by reference.

BACKGROUND

The subject of this patent application relates generally to display devices, and more particularly to a display device capable of exhibiting multi-dimensional forms of a display article retained in a region defined by the alignment of the first and the second aperture where the first and the second apertures are supported by a connectable base.

Applicant(s) hereby incorporate herein by reference any and all patents and published patent applications cited or referred to in this application.

By way of background, there has been a perpetual need in the framing sector for an enhanced solution of exhibiting multi-dimensional objects efficiently, inexpensively, and in an artistically attractive manner that facilitates viewing multi-dimensional objects from any direction while shielding the object from possible damage like fading, soiling, and the like. This concern is particularly intense when the multi-dimensional objects to be displayed involve rare or special articles which are valuable to the owner.

One way that has been utilized for the mounting and exhibit of multi-dimensional objects is the use of shadow box framing. A conventional shadow box is a frame that has a deeper than normal rabbet depth path sufficient for accommodating the dimensions of a given multi-dimensional object. Traditionally, such three-dimensional objects are mounted or covered in both sides of the frame by a translucent material (i.e., glass, plastic, etc.). A serious flaw to the shadow box approach is the lack of economy in its structural design. Shadow boxes tend to be considerably bulkier than the traditional devices for displaying two-dimensional objects and, for that matter, much bigger than the object itself. Moreover, considering that there are countless forms and sizes of objects to be displayed, shadow box framing typically calls for a custom design and production by experienced framing professionals based on the specifications of a certain object to be displayed. This creates additional expense to the customer who typically lacks the necessary skill themselves in constructing a shadow box to suit the required needs.

Other display devices use a transparent material between frames with the object being suspended in the enclosure by a mechanical fastener which is made of clear plastic, wood, or other materials. The lower portion of the display device is usually supported by a base to hold the enclosure in an upright position. However, the mechanical fastener is typically visible and can obstruct the visual appeal of the object.

There is therefore a need for an improved display device that minimizes or eliminates the presence of any conspicuous mechanical connectors to support the object in the aperture so as to enable the viewer to view the object from all directions. There is also a need for such devices to be capable of modularly connecting and stacking with one another in all directions.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a display device for selectively displaying an at least one multi-dimensional object, and associated methods of use. In at least one embodiment, the display device provides an upper portion and a corresponding lower portion configured for selective engagement with the upper portion, thereby allowing the upper portion to remain in a substantially vertical orientation. The upper portion provides a first frame and an opposing second frame selectively engageable with the first frame. The first frame provides a first aperture, the first aperture having a first window panel spanning the first aperture. The second frame provides a corresponding second aperture sized for approximating the dimensions of the first aperture, the second aperture having a second window panel spanning the second aperture. The first and second apertures cooperate to define an enclosure therebetween for selectively receiving the at least one object therewithin Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
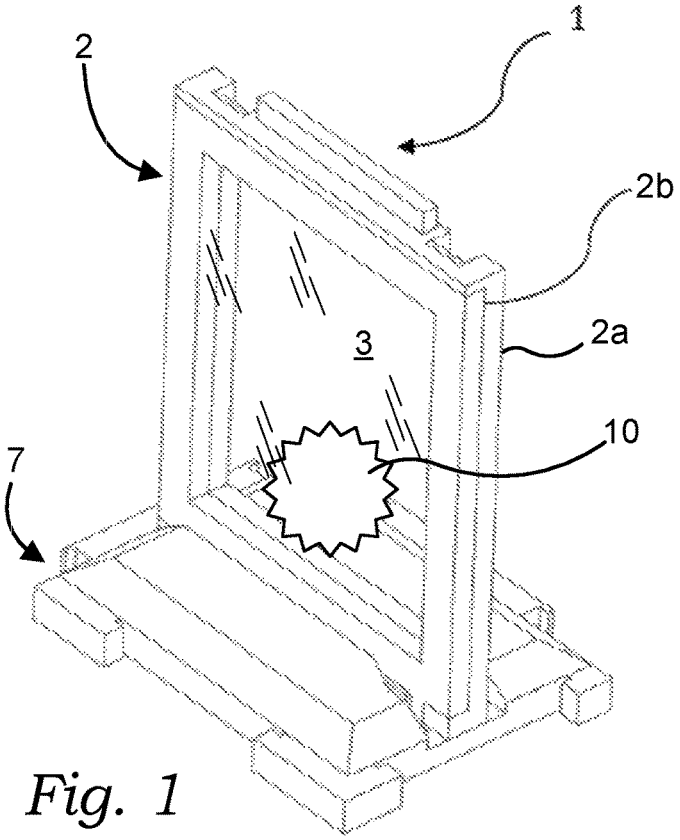
FIG. 1 is a perspective view of an exemplary display device, in accordance with at least one embodiment.
Figure 2:
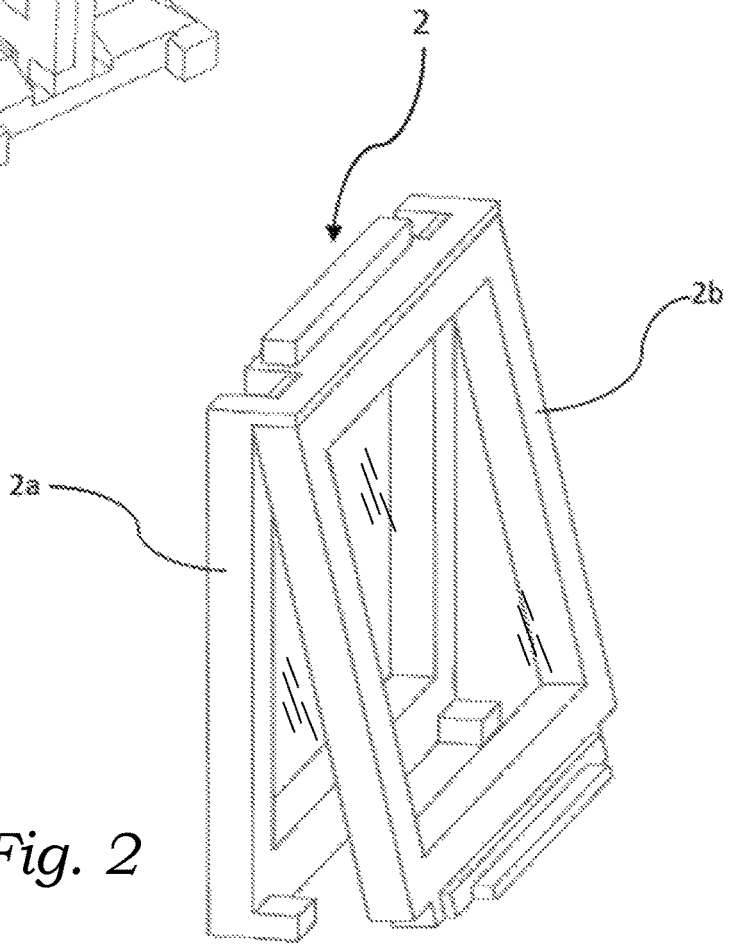
FIG. 2 is a perspective view of an upper portion thereof, in accordance with at least one embodiment.

Turning now to FIG. 1, there is shown a perspective view of an exemplary embodiment of a display device 1 for selectively displaying an at least one multi-dimensional object 10. In at least one embodiment, the display device 1 provides an upper portion 2 sized and configured for selectively enclosing and displaying the at least one object 10, and a lower portion 7 configured for selective engagement with the upper portion 2, thereby allowing the upper portion 2 to remain in a substantially vertical orientation, as discussed further below. In at least one embodiment, each of the upper portion 2 and lower portion 7 is constructed of plastic having a uniform cross section, which is laminated with a smooth plastic veneer. However, in further embodiments, any other material (or combination of materials), now known or later developed (such as thermoplastic, wood, metal, aluminum, etc.), may be substituted.

Figure 3:
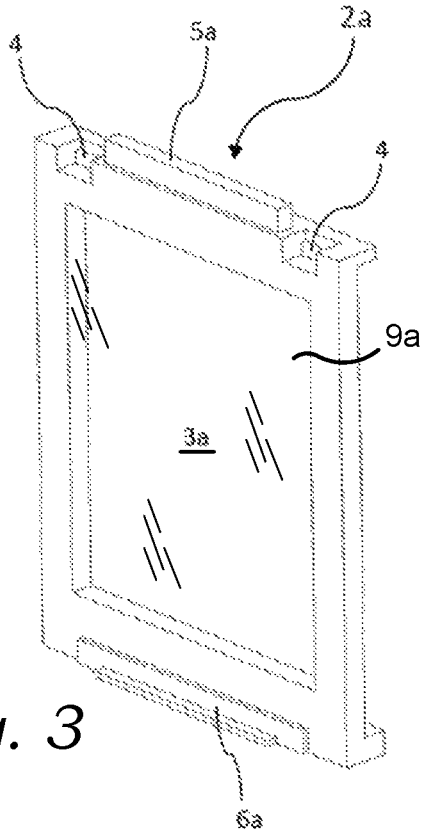
FIGS. 3 and 4 are perspective views of a first frame and an opposing second frame, respectively, of the upper portion, in accordance with at least one embodiment.
Figure 4:
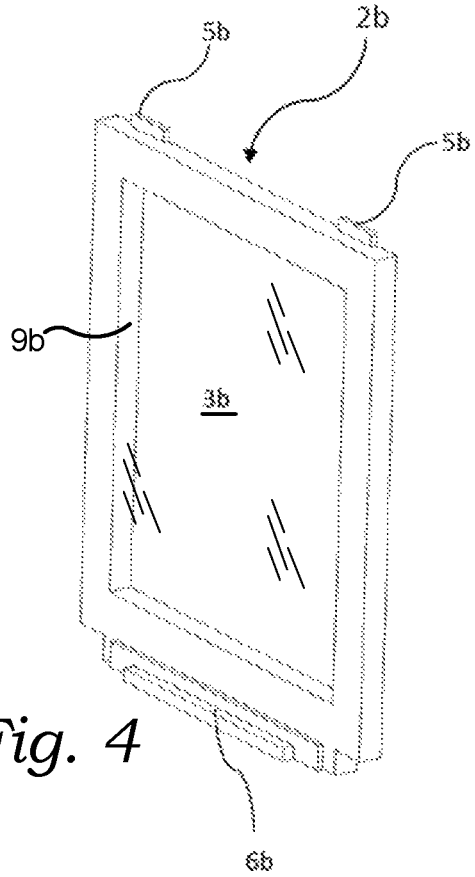

In at least one embodiment, the upper portion 2 provides a first frame 2*a* and an opposing second frame 2*b* configured for selective engagement with one another, the first and second frames 2*a* and 2*b* cooperating to define an enclosure 3 (FIG. 3) therebetween for receiving the at least one object 10 therewithin. In a bit more detail, in at least one embodiment, the first frame 2*a* provides a first aperture 3*a* having a first window panel 9*a* spanning the first aperture 3*a*, as illustrated in FIG. 3. Similarly, in at least one embodiment, the second frame 2*b* provides a corresponding second aperture 3*b* having a second window panel 9*b* spanning the second aperture 3*b*, as illustrated in FIG. 4. In at least one embodiment, the size, shape and dimensions of the first and second apertures 3*a* and 3*b* are substantially the same. Additionally, in at least one embodiment, the first and second apertures 3*a* and 3*b* are positioned and configured for being substantially aligned with one another when the first and second frames 2*a* and 2*b* are selectively engaged, such that the first and second apertures 3*a* and 3*b* define the enclosure 3. Thus, in at least one embodiment, the at least one object 10 is capable of being selectively positioned within the enclosure 3, essentially sandwiched between the first and second window panels 9*a* and 9*b*, allowing the object 10 to be displayed in virtually any direction. It should be noted that while the first and second apertures 3*a* and 3*b*, along with the first and second frames 2*a* and 2*b*, are depicted as being substantially rectangular in shape in the accompanying drawings, the scope of the present invention should not be read as being so limited. Instead, in further embodiments, the first and second frames 2*a* and 2*b*, along with the first and second apertures 3*a* and 3*b*, may take on any other size, shape, or dimensions now known or later conceived—dependent at least in part on the size, shape and dimensions of the corresponding object 10 to be displayed within the display device 1.

In at least one embodiment, the first and second window panels 9*a* and 9*b* are constructed of at least one of a transparent, semi-transparent, or translucent material, such as glass or plastic for example. In at least one embodiment, the first and second window panels 9*a* and 9*b* may further be constructed of either an elastic or inelastic material for sandwiching the at least one object therebetween. Accordingly, in at least one such embodiment, the first and second window panels 9*a* and 9*b* may be constructed of a polymeric or polyurethane material. In at least one further embodiment, the at least one object 10 may be selectively positioned within the enclosure 3 by clipping or sandwiching its side between the first frame 2*a* and second frame 2*b*. In at least one embodiment, the first and second frames 2*a* and 2*b* can hold the object 10 in place so as to conceal the support of the object 10 holding it in place within the enclosure 3. Thus, in at least one embodiment, the object 10 being displayed in the enclosure 3 may be a multi-dimensional object, such that first and second window panels 9*a* and 9*b* are configured to expand in order to conform to the multi-dimensional form of the object 10 retained therebetween. In at least one embodiment, the first frame 2*a* and the second frame 2*b* will position the object 10 in any direction within the enclosure 3.

Figure 9A:
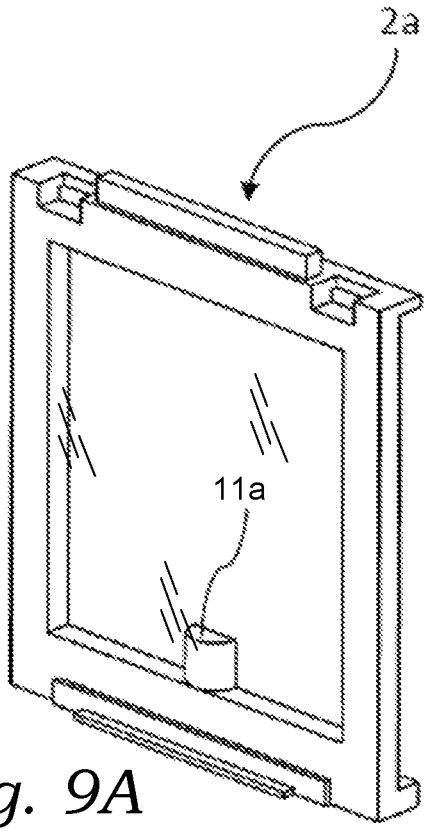
FIGS. 9A-9C are perspective views of a further embodiment of the upper portion, in accordance with at least one embodiment.
Figure 9B:
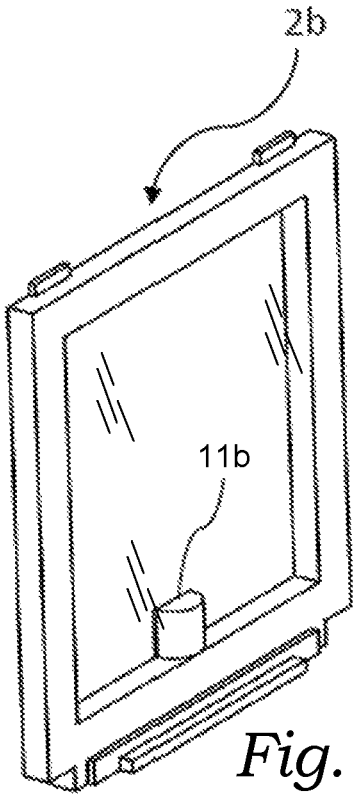
Figure 9C:
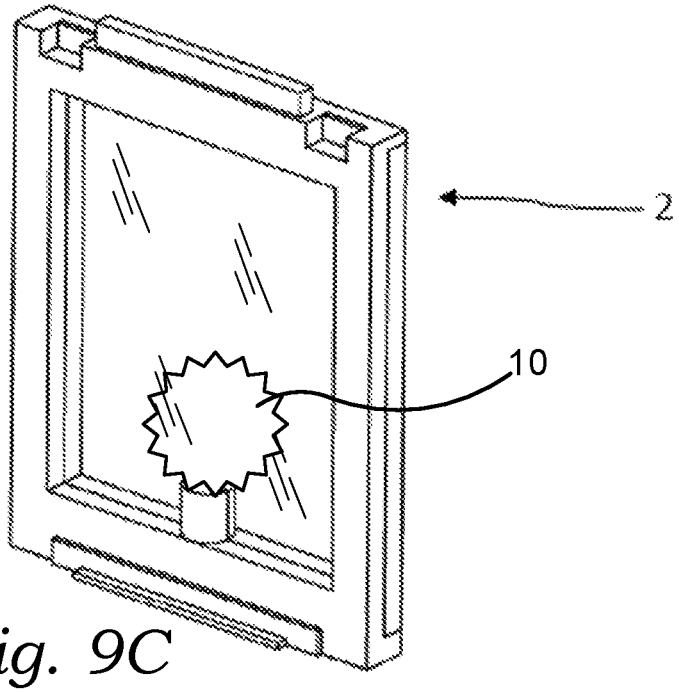

In at least one embodiment, as illustrated in FIGS. 9A-9C, each of the first and second frames 2*a* and 2*b* provides an at least one first support protrusion 11*a* and a corresponding second support protrusion 11*b* extending upwardly from a respective lower edge of the first and second apertures 3*a* and 3*b*, substantially toward a center of the enclosure 3. The first and second support protrusions 11*a* and 11*b* are positioned and configured for selectively engaging or otherwise supporting the at least one object 10 within the enclosure 3. In at least one embodiment, the first and second support protrusions 11*a* and 11*b* are constructed of a transparent material so that the object 10 will appear to be floating within the enclosure 3. It should be noted that the particular size, shape, dimensions, position and number of first and second support protrusions 11*a* and 11*b* depicted in the accompanying drawings are merely exemplary and shown for illustrative purposes. Thus, the scope of the present invention should not be read as being so limited. Instead, in further embodiments, each of the first and second support protrusions 11*a* and 11*b* may take on any other size, shape, dimensions, number or position now known or later conceived. In still further embodiments, any other structure or mechanism (or combinations thereof), now known or later developed, capable of selectively supporting the at least one object 10 within the enclosure 3 may be substituted. In at least one such embodiment, the first and second window panels 9*a* and 9*b* are omitted, such that the object 10 is supported and substantially retained within the first and second frames 2*a* and 2*b* by virtue of the first and second support protrusions 11*a* and 11*b*.

Figure 5:
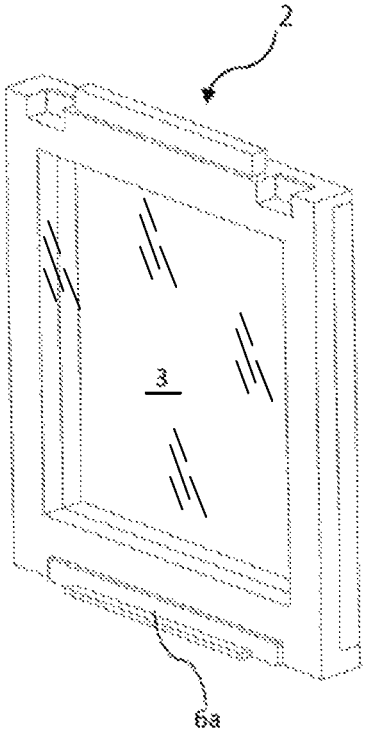
FIG. 5 is a further perspective view of the upper portion, in accordance with at least one embodiment.

In at least one embodiment, as illustrated in FIGS. 3-5, the second frame 2*b* provides an at least one engagement protrusion 5*b* disposed along an at least one perimeter edge of the second frame 2*b*, the at least one engagement protrusion 5*b* positioned and configured for selective engagement with a corresponding at least one engagement slot 4 disposed along an at least one perimeter edge of the first frame 2*a*. In at least one alternate embodiment, the at least one engagement protrusion 5*b* is provided by the first frame 2*a*, while the corresponding at least one engagement slot 4 is provided by the second frame 2*b*. It should be noted that the particular size, shape, dimensions, position and number of engagement protrusions 5*b* and corresponding engagement slots 4 depicted in the accompanying drawings are merely exemplary and shown for illustrative purposes. Thus, the scope of the present invention should not be read as being so limited. Instead, in further embodiments, each of the engagement protrusions 5*b* and corresponding engagement slots 4 may take on any other size, shape, dimensions, number or position now known or later conceived. In still further embodiments, any other structure or mechanism (or combinations thereof), now known or later developed, capable of allowing the first and second frames 2*a* and 2*b* to be selectively engaged with one another, may be substituted.

Figure 6:
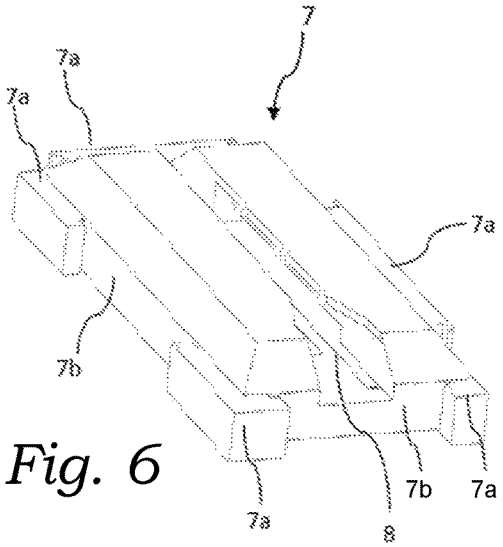
FIG. 6 is a perspective view of a lower portion of the exemplary display device, in accordance with at least one embodiment.
Figure 8:
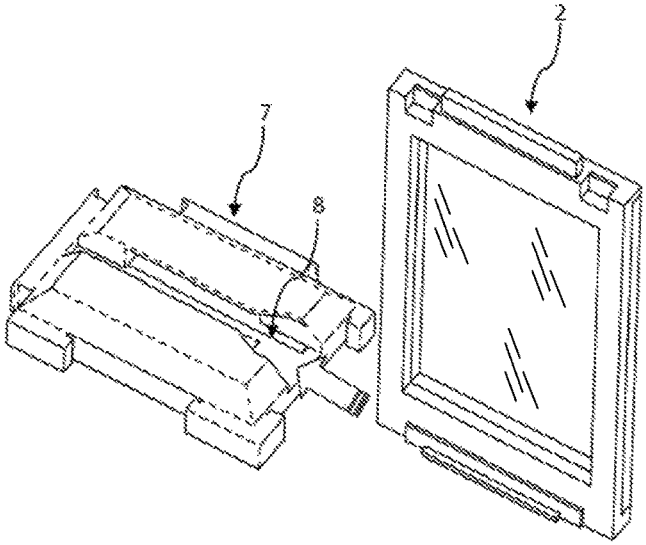
FIG. 8 is a perspective view illustrating the selective engagement between the upper portion and lower portion of the exemplary display device, in accordance with at least one embodiment.

In at least one embodiment, as illustrated in FIGS. 6 and 8, the lower portion 7 of the display device 1 is configured for selective engagement with the upper portion 2, thereby allowing the upper portion 2 to remain in a substantially vertical (i.e., upright) orientation. Thus, in at least one embodiment, the lower portion 7 functions as a base for the upper portion 2. In at least one such embodiment, an upper surface of the lower portion 7 provides a base slot 8 sized and configured for selective engagement with corresponding first and second base protrusions 6*a* and 6*b* disposed along a respective lower edge of each of the first and second frames 2*a* and 2*b*. In at least one such embodiment, the first and second base protrusions 6*a* and 6*b* are substantially L-shaped in cross-section and disposed on opposing sides of the upper portion 2, while the base slot 8 is sized and configured for allowing the first and second base protrusions 6*a* and 6*b* to be selectively slid or otherwise inserted into the base slot 8, as illustrated in FIG. 8. It should be noted that the particular size, shape, dimensions, position and number of base slots 8 and corresponding first and second base protrusions 6*a* and 6*b* depicted in the accompanying drawings are merely exemplary and shown for illustrative purposes. Thus, the scope of the present invention should not be read as being so limited. Instead, in further embodiments, each of the base slots 8 and corresponding first and second base protrusions 6*a* and 6*b* may take on any other size, shape, dimensions, number or position now known or later conceived. In still further embodiments, any other structure or mechanism (or combinations thereof), now known or later developed, capable of allowing the upper portion 2 of the display device 1 to be selectively engaged with the lower portion 7 in a substantially vertical orientation, may be substituted.

Figure 7:
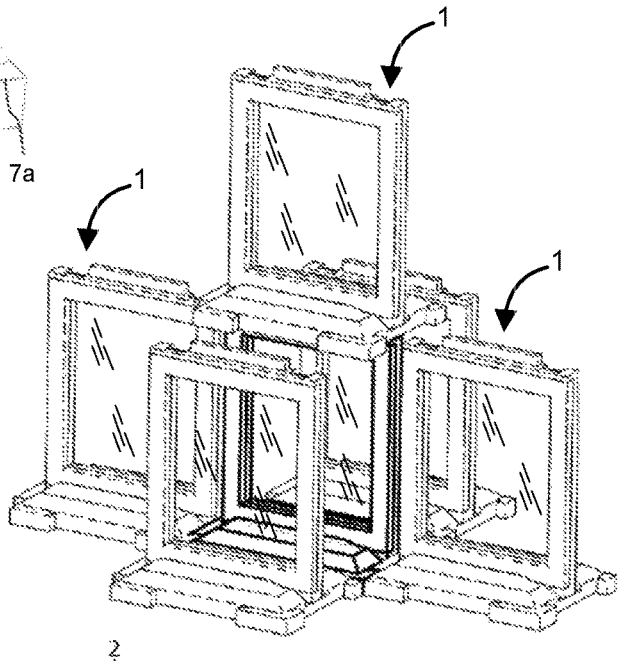
FIG. 7 is a perspective view of a plurality of exemplary display devices selectively interconnected with one another, in accordance with at least one embodiment.

In at least one embodiment, as illustrated in FIGS. 6-8, the perimeter edges of the lower portion 7 provides an at least one base connector protrusion 7*a* and a corresponding at least one base connector slot 7*b*. The at least one base connector protrusion 7*a* of the lower portion 7 is positioned and configured for selective engagement with a corresponding at least one base connector slot 7*b* of a further lower portion 7. Similarly, the at least one base connector slot 7*b* of the lower portion 7 is positioned and configured for selective engagement with a corresponding at least one base connector protrusion 7*a* of a further lower portion 7. In this way, in at least one such embodiment, multiple display devices 1 may be selectively engaged with one another in a horizontally connected arrangement. In at least one embodiment, the at least one base connector protrusion 7*a* is formed with a relatively narrow neck portion and a relatively wider top portion extending outwardly therefrom. It should be noted that the particular size, shape, dimensions, position and number of base connector protrusions 7*a* and corresponding base connector slots 7*b*, along with the lower portion 7 itself, depicted in the accompanying drawings are merely exemplary and shown for illustrative purposes. Thus, the scope of the present invention should not be read as being so limited. Instead, in further embodiments, each of the base connector protrusions 7*a* and corresponding base connector slots 7*b*, along with the lower portion 7, may take on any other size, shape, dimensions, number or position now known or later conceived. In still further embodiments, any other structure or mechanism (or combinations thereof), now known or later developed, capable of allowing multiple display devices 1 to be selectively engaged with one another in a horizontally connected arrangement, may be substituted.

In at least one embodiment, the first frame 2*a* provides an at least one frame connector protrusion 5*a* disposed along an upper edge of the first frame 2*a*, the at least one frame connector protrusion 5*a* positioned and configured for selective engagement with a corresponding at least one frame connector slot (not shown) disposed along a bottom surface of the lower portion 7 of a further display device 1. In this way, in at least one such embodiment, multiple display devices 1 may be selectively engaged with one another in a vertically stacked arrangement. In at least one such embodiment, the frame connector protrusion 5*a* is positioned between a pair of engagement slots 4 along the upper edge of the first frame 2*a*, as illustrated best in FIG. 3. In at least one alternate embodiment, the at least one frame connector protrusion 5*a* is positioned along an upper edge of the second frame 2*b*. It should be noted that the particular size, shape, dimensions, position and number of frame connector protrusions 5*a* and corresponding frame connector slots depicted in the accompanying drawings are merely exemplary and shown for illustrative purposes. Thus, the scope of the present invention should not be read as being so limited. Instead, in further embodiments, each of the frame connector protrusions 5*a* and corresponding frame connector slots may take on any other size, shape, dimensions, number or position now known or later conceived. In still further embodiments, any other structure or mechanism (or combinations thereof), now known or later developed, capable of allowing multiple display devices 1 to be selectively engaged with one another in a vertically stacked arrangement, may be substituted. Thus, in at least one embodiment, as illustrated in FIG. 7, through the base connector protrusions 7*a*, base connector slots 7*b*, frame connector protrusions 5*a*, and frame connector slots, multiple display devices 1 are able to be selectively engaged with one another and stacked in virtually any direction.

Aspects of the present specification may also be described as follows:

1. A display device for selectively displaying an at least one multi-dimensional object, the display device comprising: an upper portion sized and configured for selectively enclosing and displaying the at least one object, the upper portion comprising: a first frame providing a first aperture, the first aperture having a first window panel spanning the first aperture; an opposing second frame configured for selective engagement with the first frame, the second frame providing a second aperture sized for approximating the dimensions of the first aperture, the second aperture having a second window panel spanning the second aperture; and the first and second apertures cooperating to define an enclosure therebetween for selectively receiving the at least one object therewithin; and a lower portion configured for selective engagement with the upper portion, thereby allowing the upper portion to remain in a substantially vertical orientation while also locking the first and second frames together.

2. The display device according to embodiment 1, wherein the first and second window panels are constructed of at least one of a transparent, semi-transparent, or translucent material.

3. The display device according to embodiments 1-2, wherein the first and second window panels are constructed of an elastic material.

4. The display device according to embodiments 1-3, wherein the first and second window panels are configured for selectively expanding in order to conform to a shape of the at least one object retained therebetween.

5. The display device according to embodiments 1-4, further comprising: an at least one first support protrusion extending upwardly from a lower edge of the first aperture of the first frame, substantially toward a center of the enclosure; and a corresponding at least one second support protrusion extending upwardly from a lower edge of the second aperture of the second frame, substantially toward a center of the enclosure; said first and second support protrusions positioned and configured for cooperating to selectively engage or otherwise support the at least one object thereon.

6. The display device according to embodiments 1-5, wherein the first and second support protrusions are constructed of a transparent material.

7. The display device according to embodiments 1-6, further comprising an at least one engagement protrusion disposed along an at least one perimeter edge of the second frame, the at least one engagement protrusion positioned and configured for selective engagement with a corresponding at least one engagement slot disposed along an at least one perimeter edge of the first frame.

8. The display device according to embodiments 1-7, further comprising an at least one engagement protrusion disposed along an at least one perimeter edge of the first frame, the at least one engagement protrusion positioned and configured for selective engagement with a corresponding at least one engagement slot disposed along an at least one perimeter edge of the second frame.

9. The display device according to embodiments 1-8, further comprising: an at least one first base protrusion disposed along a lower edge of the first frame; a corresponding at least one second base protrusion disposed along a lower edge of the second frame; and an at least one base slot positioned on an upper surface of the lower portion, the at least one base slot sized and configured for removably receiving each of the at least one first base protrusion and second base protrusion when the first and second frames are selectively engaged with one another.

10. The display device according to embodiments 1-9, wherein the first and second base protrusions are substantially L-shaped in cross-section and disposed on opposing sides of the upper portion.

11. The display device according to embodiments 1-10, further comprising: an at least one base connector protrusion disposed along a perimeter edge of the lower portion; and an at least one base connector slot disposed along the perimeter edge of the lower portion; the at least one base connector protrusion of the lower portion positioned and configured for selective engagement with a corresponding at least one base connector slot of a further lower portion; the at least one base connector slot of the lower portion positioned and configured for selective engagement with a corresponding at least one base connector protrusion of a further lower portion; whereby, multiple display devices are capable of being selectively engaged with one another, via the respective lower portions thereof, in a horizontally connected arrangement.

12. The display device according to embodiments 1-11, wherein the at least one base connector protrusion is formed with a relatively narrow neck portion and a relatively wider top portion extending outwardly therefrom.

13. The display device according to embodiments 1-12, further comprising: an at least one frame connector protrusion disposed along an upper edge of the upper portion; an at least one frame connector slot disposed along a bottom surface of the lower portion; the at least one frame connector protrusion positioned and configured for selective engagement with a corresponding at least one frame connector slot of a further display device; and the at least one frame connector slot positioned and configured for selective engagement with a corresponding at least one frame connector protrusion of a further display device; whereby, multiple display devices are capable of being selectively engaged with one another, via the respective frame connector protrusions and frame connector slots thereof, in a vertically stacked arrangement.

14. The display device according to embodiments 1-13, wherein the at least one frame connector protrusion is disposed along an upper edge of the first frame.

15. The display device according to embodiments 1-14, wherein the at least one frame connector protrusion is disposed along an upper edge of the second frame.

16. A display device for selectively displaying an at least one multi-dimensional object, the display device comprising: an upper portion sized and configured for selectively enclosing and displaying the at least one object, the upper portion comprising: a first frame providing a first aperture; an opposing second frame configured for selective engagement with the first frame, the second frame providing a second aperture sized for approximating the dimensions of the first aperture; the first and second apertures cooperating to define an enclosure therebetween for selectively receiving the at least one object therewithin; an at least one first support protrusion extending upwardly from a lower edge of the first aperture of the first frame, substantially toward a center of the enclosure; a corresponding at least one second support protrusion extending upwardly from a lower edge of the second aperture of the second frame, substantially toward a center of the enclosure; and said first and second support protrusions positioned and configured for cooperating to selectively engage or otherwise support the at least one object thereon; and a lower portion configured for selective engagement with the upper portion, thereby allowing the upper portion to remain in a substantially vertical orientation while also locking the first and second frames together.

17. A display device for selectively displaying an at least one multi-dimensional object, the display device comprising: an upper portion sized and configured for selectively enclosing and displaying the at least one object, the upper portion comprising: a first frame providing a first aperture, the first aperture having a first window panel spanning the first aperture; an opposing second frame configured for selective engagement with the first frame, the second frame providing a second aperture sized for approximating the dimensions of the first aperture, the second aperture having a second window panel spanning the second aperture; the first and second apertures cooperating to define an enclosure therebetween for selectively receiving the at least one object therewithin; and an at least one frame connector protrusion disposed along an upper edge of the upper portion; and a lower portion configured for selective engagement with the upper portion, thereby allowing the upper portion to remain in a substantially vertical orientation while also locking the first and second frames together, the lower portion comprising: an at least one base connector protrusion disposed along a perimeter edge of the lower portion; an at least one base connector slot disposed along the perimeter edge of the lower portion; the at least one base connector protrusion of the lower portion positioned and configured for selective engagement with a corresponding at least one base connector slot of a further lower portion; the at least one base connector slot of the lower portion positioned and configured for selective engagement with a corresponding at least one base connector protrusion of a further lower portion; and an at least one frame connector slot disposed along a bottom surface of the lower portion, the at least one frame connector slot positioned and configured for selective engagement with a corresponding at least one frame connector protrusion of a further display device; whereby, multiple display devices are capable of being selectively engaged with one another in at least one of a horizontally connected and vertically stacked arrangement.

In closing, regarding the exemplary embodiments of the present invention as shown and described herein, it will be appreciated that a display device and associated methods of use are disclosed. Because the principles of the invention may be practiced in a number of configurations beyond those shown and described, it is to be understood that the invention is not in any way limited by the exemplary embodiments, but is generally directed to a display device and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A display device for selectively displaying an at least one multi-dimensional object, the display device comprising:

an upper portion sized and configured for selectively enclosing and displaying the at least one object, the upper portion comprising:

a first frame providing a first aperture, the first aperture having a first window panel spanning the first aperture;

an opposing second frame configured for selective engagement with the first frame, the second frame providing a second aperture sized for approximating the dimensions of the first aperture, the second aperture having a second window panel spanning the second aperture;

an at least one first base protrusion, substantially L-shaped in cross-section and disposed along a lower edge of the first frame;

an opposing at least one second base protrusion, substantially L-shaped in cross-section and disposed along a lower edge of the second frame; and the first and second apertures cooperating to define an enclosure therebetween for selectively receiving the at least one object therewithin; and a lower portion configured for selective engagement with the upper portion, thereby allowing the upper portion to remain in a substantially vertical orientation while also locking the first and second frames together, an upper surface of the lower portion providing an at least one base slot sized and configured for removably receiving each of the at least one first base protrusion and second base protrusion when the first and second frames are selectively engaged with one another.

2. The display device of claim 1, wherein the first and second window panels are constructed of at least one of a transparent, semi-transparent, or translucent material.

3. The display device of claim 2, wherein the first and second window panels are constructed of an elastic material.

4. The display device of claim 3, wherein the first and second window panels are configured for selectively expanding in order to conform to a shape of the at least one object retained therebetween.

5. The display device of claim 1, further comprising:

an at least one first support protrusion extending upwardly from a lower edge of the first aperture of the first frame, substantially toward a center of the enclosure; and a corresponding at least one second support protrusion extending upwardly from a lower edge of the second aperture of the second frame, substantially toward a center of the enclosure;

said first and second support protrusions positioned and configured for cooperating to selectively engage or otherwise support the at least one object thereon.

6. The display device of claim 5, wherein the first and second support protrusions are constructed of a transparent material.

7. The display device of claim 1, further comprising an at least one engagement protrusion disposed along an at least one perimeter edge of the second frame, the at least one engagement protrusion positioned and configured for selective engagement with a corresponding at least one engagement slot disposed along an at least one perimeter edge of the first frame.

8. The display device of claim 1, further comprising an at least one engagement protrusion disposed along an at least one perimeter edge of the first frame, the at least one engagement protrusion positioned and configured for selective engagement with a corresponding at least one engagement slot disposed along an at least one perimeter edge of the second frame.

9. The display device of claim 1, further comprising:

an at least one base connector protrusion disposed along a perimeter edge of the lower portion; and an at least one base connector slot disposed along the perimeter edge of the lower portion;

the at least one base connector protrusion of the lower portion positioned and configured for selective engagement with a corresponding at least one base connector slot of a further lower portion;

the at least one base connector slot of the lower portion positioned and configured for selective engagement with a corresponding at least one base connector protrusion of a further lower portion;

whereby, multiple display devices are capable of being selectively engaged with one another, via the respective lower portions thereof, in a horizontally connected arrangement.

10. The display device of claim 9, wherein the at least one base connector protrusion is formed with a relatively narrow neck portion and a relatively wider top portion extending outwardly therefrom.

11. The display device of claim 1, further comprising:

an at least one frame connector protrusion disposed along an upper edge of the upper portion;

an at least one frame connector slot disposed along a bottom surface of the lower portion;

the at least one frame connector protrusion positioned and configured for selective engagement with a corresponding at least one frame connector slot of a further display device; and the at least one frame connector slot positioned and configured for selective engagement with a corresponding at least one frame connector protrusion of a further display device;

whereby, multiple display devices are capable of being selectively engaged with one another, via the respective frame connector protrusions and frame connector slots thereof, in a vertically stacked arrangement.

12. The display device of claim 11, wherein the at least one frame connector protrusion is disposed along an upper edge of the first frame.

13. The display device of claim 11, wherein the at least one frame connector protrusion is disposed along an upper edge of the second frame.

14. A display device for selectively displaying an at least one multi-dimensional object, the display device comprising:

an upper portion sized and configured for selectively enclosing and displaying the at least one object, the upper portion comprising:

a first frame providing a first aperture;

an opposing second frame configured for selective engagement with the first frame, the second frame providing a second aperture sized for approximating the dimensions of the first aperture;

the first and second apertures cooperating to define an enclosure therebetween for selectively receiving the at least one object therewithin;

an at least one first support protrusion extending upwardly from a lower edge of the first aperture of the first frame, substantially toward a center of the enclosure;

a corresponding at least one second support protrusion extending upwardly from a lower edge of the second aperture of the second frame, substantially toward a center of the enclosure; and said first and second support protrusions positioned and configured for cooperating to selectively engage or otherwise support the at least one object thereon; and a lower portion configured for selective engagement with the upper portion, thereby allowing the upper portion to remain in a substantially vertical orientation while also locking the first and second frames together.

15. A display device for selectively displaying an at least one multi-dimensional object, the display device comprising:

an upper portion sized and configured for selectively enclosing and displaying the at least one object, the upper portion comprising:

a first frame providing a first aperture, the first aperture having a first window panel spanning the first aperture;

an opposing second frame configured for selective engagement with the first frame, the second frame providing a second aperture sized for approximating the dimensions of the first aperture, the second aperture having a second window panel spanning the second aperture;

an at least one first base protrusion, substantially L-shaped in cross-section and disposed along a lower edge of the first frame;

an opposing at least one second base protrusion, substantially L-shaped in cross-section and disposed along a lower edge of the second frame;

the first and second apertures cooperating to define an enclosure therebetween for selectively receiving the at least one object therewithin; and an at least one frame connector protrusion disposed along an upper edge of the upper portion; and a lower portion configured for selective engagement with the upper portion, thereby allowing the upper portion to remain in a substantially vertical orientation while also locking the first and second frames together, the lower portion comprising:

an at least one base slot positioned on an upper surface of the lower portion, the at least one base slot sized and configured for removably receiving each of the at least one first base protrusion and second base protrusion when the first and second frames are selectively engaged with one another;

an at least one base connector protrusion disposed along a perimeter edge of the lower portion;

an at least one base connector slot disposed along the perimeter edge of the lower portion;

the at least one base connector protrusion of the lower portion positioned and configured for selective engagement with a corresponding at least one base connector slot of a further lower portion;

the at least one base connector slot of the lower portion positioned and configured for selective engagement with a corresponding at least one base connector protrusion of a further lower portion; and an at least one frame connector slot disposed along a bottom surface of the lower portion, the at least one frame connector slot positioned and configured for selective engagement with a corresponding at least one frame connector protrusion of a further display device;

whereby, multiple display devices are capable of being selectively engaged with one another in at least one of a horizontally connected and vertically stacked arrangement.

* * * * *